US008176883B2

(12) United States Patent
Brown et al.

(10) Patent No.: US 8,176,883 B2
(45) Date of Patent: May 15, 2012

(54) RETRACTABLE ARTICULATING ROBOTIC SOOTBLOWER

(75) Inventors: Clinton A. Brown, Baltimore, OH (US); Stephen L. Shover, Millersport, OH (US); Ryan M. Tooill, Rushville, OH (US)

(73) Assignee: Diamond Power International, Inc., Lancaster, OH (US)

( * ) Notice: Subject to any disclaimer, the term of this patent is extended or adjusted under 35 U.S.C. 154(b) by 565 days.

(21) Appl. No.: 12/393,441

(22) Filed: Feb. 26, 2009

(65) Prior Publication Data

US 2010/0212608 A1 Aug. 26, 2010

(51) Int. Cl.
*F22B 37/48* (2006.01)

(52) U.S. Cl. ..... 122/379; 122/390; 134/167 R; 134/172

(58) Field of Classification Search ..... 122/379, 122/390, 381, 383, 405; 134/167 R, 172, 134/180, 181
See application file for complete search history.

(56) References Cited

U.S. PATENT DOCUMENTS

| | | | | |
|---|---|---|---|---|
| 1,416,708 | A | 5/1922 | Hagedorn et al. | |
| 3,216,046 | A | 11/1965 | Chappell | |
| 3,601,136 | A | 8/1971 | Marcham | |
| 4,248,180 | A * | 2/1981 | Sullivan et al. | 122/390 |
| 4,273,076 | A * | 6/1981 | Lahoda et al. | 122/382 |
| 4,498,213 | A | 2/1985 | Zalewski | |
| 4,646,768 | A | 3/1987 | Tanaka et al. | |
| 4,803,959 | A * | 2/1989 | Sherrick et al. | 122/379 |
| 4,844,021 | A | 7/1989 | Stoss | |
| 5,040,262 | A | 8/1991 | Albers et al. | |
| 5,069,172 | A * | 12/1991 | Shirey et al. | 122/382 |
| 5,172,653 | A * | 12/1992 | Vadakin | 122/392 |
| 5,337,441 | A | 8/1994 | Miyamoto et al. | |
| 5,353,996 | A | 10/1994 | Gallacher et al. | |
| 5,381,811 | A * | 1/1995 | Boisture | 134/167 R |
| 5,416,946 | A | 5/1995 | Brown et al. | |
| 5,509,607 | A | 4/1996 | Booher et al. | |
| 5,564,371 | A * | 10/1996 | Ashton et al. | 122/392 |
| 5,605,117 | A | 2/1997 | Moskal | |
| 5,810,473 | A | 9/1998 | Manabe et al. | |
| RE36,465 | E | 12/1999 | Boisture | |
| 6,575,122 | B2 * | 6/2003 | Hipple | 122/379 |

(Continued)

FOREIGN PATENT DOCUMENTS

DE 3536788 4/1987

OTHER PUBLICATIONS

Water Towers, Snozzle, Pierce, Jul. 3, 2007.

(Continued)

*Primary Examiner* — Gregory A Wilson
(74) *Attorney, Agent, or Firm* — Brinks Hofer Gilson & Lione

(57) ABSTRACT

A sootblower is provided having a multidirectional cleaning range for directing a cleaning medium against heated surfaces in a heat exchanger. The sootblower includes a rotatable lance tube that is selectively advanced and withdrawn along a longitudinal axis from an interior volume of the heat exchanger. The lance tube includes an articulating wrist coupled to a nozzle for projecting the cleaning medium in multi-directions onto the heated surfaces when the lance tube is advanced into the heat exchanger. The nozzle is pivotable about the longitudinal axis and about a second axis transverse to the longitudinal axis.

18 Claims, 9 Drawing Sheets

U.S. PATENT DOCUMENTS

| | | | | |
|---|---|---|---|---|
| 6,672,257 | B1 * | 1/2004 | Ashton et al. | 122/379 |
| 6,755,258 | B1 | 6/2004 | Hunke et al. | |
| 6,772,775 | B2 | 8/2004 | Ackerman et al. | |
| 6,782,902 | B2 | 8/2004 | Shover et al. | |
| 6,892,679 | B2 * | 5/2005 | Jameel et al. | 122/379 |
| 7,204,208 | B2 | 4/2007 | Johnson et al. | |
| 7,367,079 | B2 | 5/2008 | Schwade et al. | |
| 2003/0015151 | A1 | 1/2003 | Hipple | |
| 2004/0089329 | A1 | 5/2004 | Bijster | |

OTHER PUBLICATIONS

Water Towers, Sky Boom, Pierce, Jul. 3, 2007.

Rosie Mobile Worksystem for D & D: Overview of System Capabilities and CP-5 Reactor Application, RedZone Robotics, Inc.

Staicu, Stefan, "Planetary Gear Train for Robotics", Department of Mechanics, University of Politehnica of Bucharest, Proceedings of the 2005 IEEE International Conference on Mechatronics, ICM '05, v 2005, p. 840-845.

* cited by examiner

RETRACTABLE ARTICULATING ROBOTIC SOOTBLOWER

FIELD OF THE INVENTION

The present invention relates generally to a sootblower type apparatus for cleaning interior surfaces of a small- and large-scale combustion heat exchanger device, and more particularly, to a sootblower having a multidirectional cleaning range.

BACKGROUND AND SUMMARY OF THE INVENTION

During the operation of small- and large-scale combustion devices, such as boilers, furnaces, and other such devices that burn fossil fuels (or pulp and paper recovery mill, and oil refineries), slag and ash encrustations develop on interior surfaces of the boiler. The presence of these deposits degrades the thermal efficiency of the boiler. Therefore, it is periodically necessary to remove such encrustations. Various systems are currently used to remove these encrustations.

One such type of system is referred to as a "sootblower." Sootblowers are used to project a stream of cleaning fluid (e.g., air, steam, water, CO2, environmental control chemical, etc.) through one or more nozzles against interior surfaces of the boiler. In the case of a retracting type sootblower, a lance tube is periodically advanced into and withdrawn from the boiler. As the lance tube is moved into and out of the boiler, it may also rotate or oscillate in order to direct one or more jets of cleaning fluid at desired surfaces within the boiler. In the case of stationary sootblowers, the lance tube is maintained within the boiler and is periodically activated to discharge cleaning fluid. Sootblower lance tubes penetrate the boiler through openings in the boiler wall, referred to as wall ports. The wall ports may include a mounting assembly, such as a wall box, in order to mount the sootblower to the boiler wall and seal the port.

Another such type of system includes a device commonly referred to as a "water cannon." Water cannons involve the use of a monitor or nozzle positioned within a wall port in order to eject a stream of fluid, such as water, against the interior surfaces of the boiler. The water cannon nozzle typically includes a pivot joint to permit adjustment of the direction of the stream of fluid. Similar to the sootblower, the water cannon nozzle is positioned within the wall port via a mounting assembly, such as a wall box. Unlike the sootblower, however, the water cannon nozzle preferably includes a pivotable ball or cardon joint coupled with the wall box in order to adjust the direction of the stream of fluid flowing into the boiler interior volume. Due to the presence of the pivotable joint, the wall port for a water cannon assembly is typically larger than the wall port for a sootblower. As a result, water cannons generally require greater installation costs than sootblowers.

Conventional sootblowers deliver the cleaning fluid into the boiler at a high pressure to facilitate the removal of the encrustations. Supplying steam or water to the boiler consumes energy and lowers the overall efficiency of the boiler system. Therefore, cleaning should be done only when needed. Conventional sootblowers have nozzles mounted in a fixed position to the lance tube and are inserted into a boiler longitudinally along a single axis and are rotated about that axis, and therefore have limited cleaning ranges. Consequently, such sootblowers are not capable of spraying the cleaning fluid against all of the nearby surfaces within the boiler requiring cleaning.

Furthermore, sootblowers cleaning with steam or water carry the risk of causing steam tube erosion. Rapid deterioration of the boiler steam tubes can occur as a result of thermal shock from the cleaning process. The potential for damage to the boiler surfaces is greater if the cleaning fluid is sprayed against a bare boiler tube after it has been cleaned, such that the cleaning fluid contacts the surface directly rather than contacting an encrustation on the surface. If a particular sootblower has an insufficient range of cleaning, an array of adjacent sootblowers may be provided at additional cost. In such cases, the jet stream from two or more adjacent sootblowers may overlap one another to the extent that certain areas of the heated surfaces become excessively cleaned and therefore deteriorate. Conventional sootblowers, due to limitations in their articulation, do not provide a constant rate of cleaning medium progression along the surfaces to be cleaned. This leads to insufficient cleaning of some areas, and over cleaning of others.

In addition to guarding against the potential deterioration of the boiler surfaces being cleaned, it is also desirable to guard against component damage of the sootblower coupled to the wall box of the boiler. In particular, due to the hostile conditions of the interior of an operating boiler, components entering the interior of the boiler (e.g., nozzles, lance tubes, etc.) may experience heat-related stresses and corrosion. As a result, it has been observed that the hostile environment in which sootblowers are employed pose significant maintenance challenges.

In view of the above, there is a need in the art to provide an improved sootblower for cleaning heated surfaces of small- and large-scare combustion devices.

SUMMARY OF THE INVENTION

In overcoming the disadvantages and drawbacks of the known technology, the present invention provides a sootblower having a multidirectional cleaning range for cleaning heated surfaces in a heat exchanger. The sootblower includes a retractable lance tube moved by a carriage assembly to selectively insert and withdraw the lance tube into and from the heat exchanger along a longitudinal axis.

The sootblower may include a motor operatively connected to the lance tube and operable to rotate the lance tube about its longitudinal axis. The lance tube may be rotated as the lance tube is inserted and/or retracted from the heat exchanger. The sootblower further includes an articulating wrist on the lance tube at its distal end. A wrist motor drive coupled to the lance tube at its proximal end adjacent to the carriage assembly, is operatively connected to the articulating wrist and is operable to rotate the articulating wrist about a second axis that is transverse to the longitudinal axis. The articulating wrist may be rotated about the second axis independently of or simultaneously with the rotation of the lance tube.

A nozzle is attached to the articulating wrist and projects a jet of cleaning medium in multi-directions against the heated surfaces when the lance tube is inserted into the heat exchanger. The nozzle is connected to a cleaning medium source for supplying cleaning medium to the nozzle via a passageway within the lance tube. In addition, the cleaning medium supplied to the nozzle cools the articulating wrist during operation of the sootblower.

Additional benefits and advantages of the present invention will become apparent to those skilled in the art to which the invention relates from the subsequent description of the preferred embodiment and the appended claims, taken in conjunction with the accompanying drawings.

DETAILED DESCRIPTION OF THE PREFERRED EMBODIMENT

Figure 1:
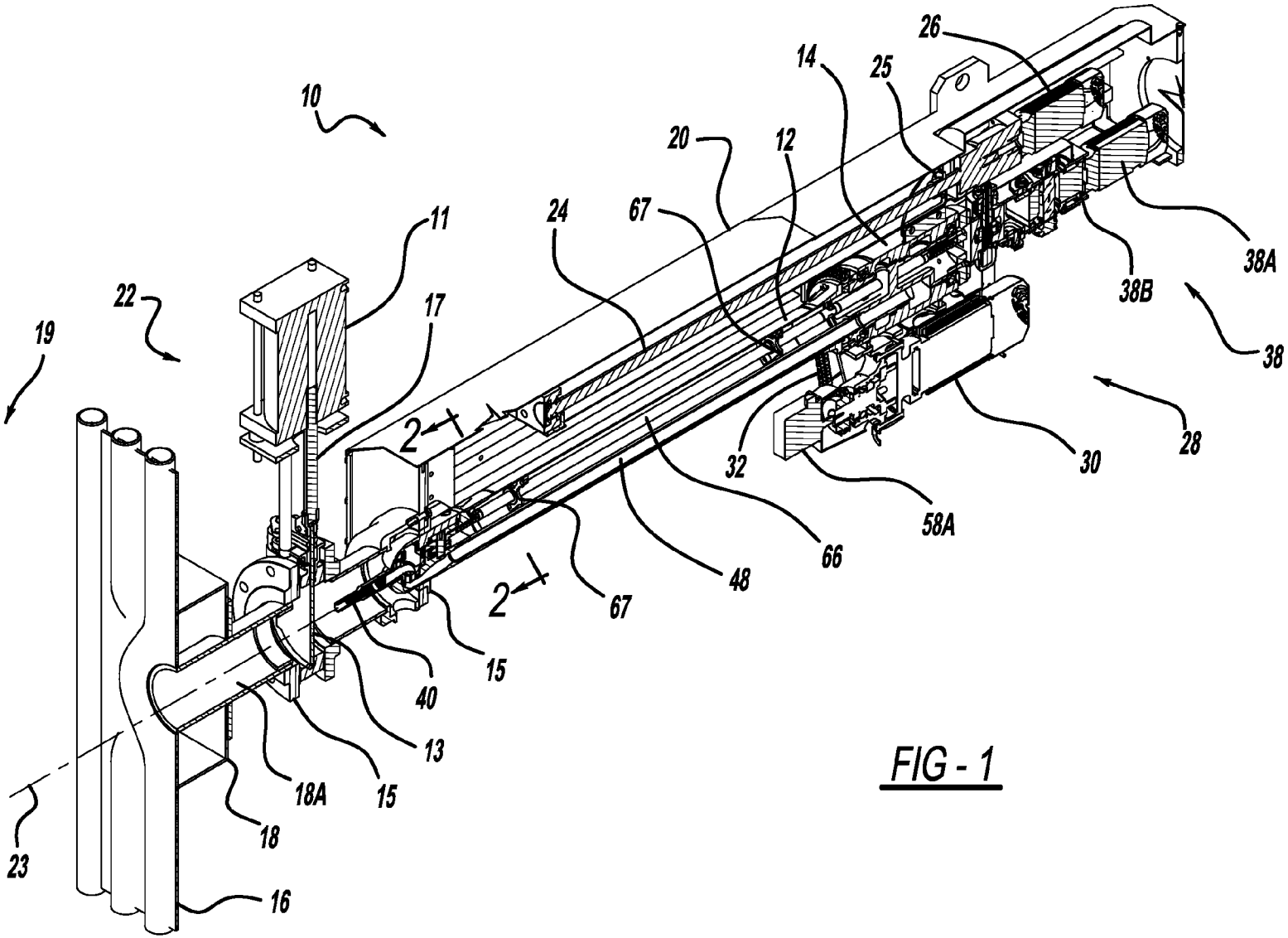
FIG. 1 is a longitudinal cross-sectional view of a sootblower in accordance with the present invention.

Referring now to FIG. 1, a sootblower embodying principles of the present invention is illustrated therein and designated generally by reference numeral 10. The sootblower 10 comprises a retractable lance tube 12 affixed to a carriage assembly 14. One or more bearings may be provided to support the lance tube 12 to the carriage assembly 14. The sootblower 10, shown in its normal resting non-operational position in FIG. 1, is located adjacent to boiler wall tubes 16 so that the lance tube 12 is aligned with a wall box 18 of a boiler (not shown). The wall box 18 includes an access port 18A which allows penetration of the boiler interior 19 by the lance tube 12. The sootblower 10 is supported by a support beam 20 (or frame) which is in turn affixed to the wall box 18.

The wall box 18 may be protected from heated boiler gasses by a crotch plate and/or a layer of refractory material designed to protect the wall box 18 from the high temperatures inside the boiler. It should be noted, however, that due to the size and construction of the sootblower 10 of the present invention, a relatively small access port area is needed, which may reduce or even eliminate the need for refractory material.

As shown in FIG. 1, an isolation gate valve assembly 22 for preventing boiler gasses from leaking out of the boiler is fixedly disposed between the wall box 18 and a distal end of the lance tube 12. The isolation gate valve assembly 22 comprises an actuator 11 such as a pneumatic or hydraulic driven cylinder having a vertical through-bore and an elongated piston rod 17 extending therethrough. The elongated piston rod 17 is secured to a top end of an isolation plate 13 and is operable to shift the isolation plate 13 upward and downward between a valve open position (FIG. 9) and a valve closed position (FIG. 1).

Upon actuation, the carriage assembly 14 will cause translational movement of the lance tube 12, advancing it into and retracting it from the boiler along a first or longitudinal axis defined by the lance tube 12 and generally designated at 23. The lance tube 12 is configured to rotate about its longitudinal axis 23 during advancement and/or retraction through movement of the carriage assembly 14 along the support beam 20. The sootblower 10 may comprise one or more bushings 15 to support the lance tube 12 during its translational and rotational movement.

Various techniques known to those of skill in the art may be employed for permitting translational movement of the lance tube 12. For instance, a conventional chain drive system may be used. Alternatively, the carriage assembly 14 may travel on rollers (not shown) and may be driven by pinion gears which engage toothed racks assemblies (not shown) rigidly connected to the support beam 20. In an exemplary embodiment, a rotatably driven lead screw 24 is longitudinally disposed within the support beam 20. The carriage assembly 14 is affixed to the lead screw 24 by way of a threaded nut 25 and is rigidly supported by a set of guide rollers. The lead screw 24 is operatively connected to a carriage motor drive 26 operable to rotate the lead screw 24 and thereby induce linear motion of the carriage assembly 14. As a result, the carriage assembly 14 is operable to advance and retract the lance tube 12 to and from the boiler.

Figure 2:
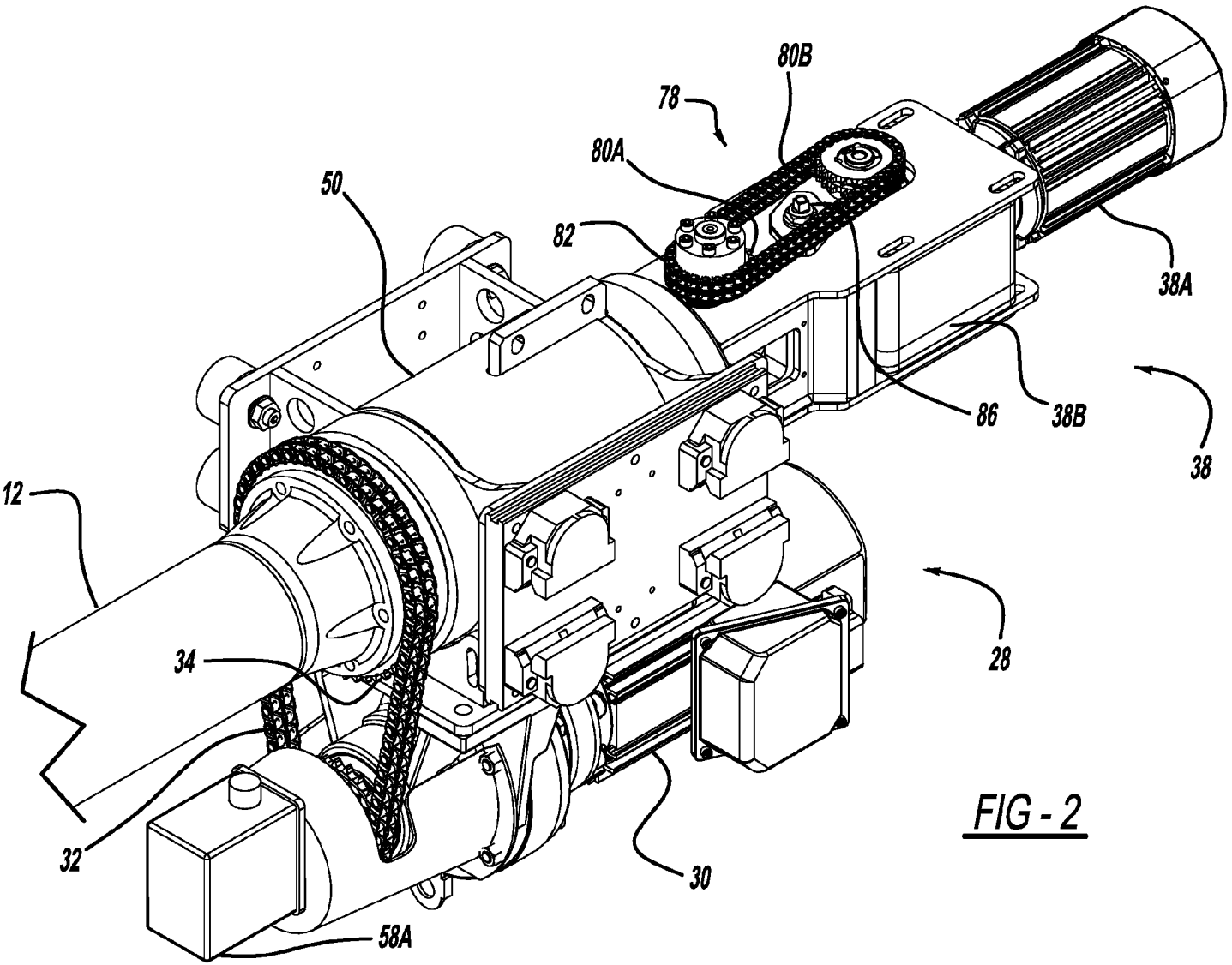
FIG. 2 is an enlarged isometric end view of the sootblower in FIG. 1.

The carriage assembly 14 is affixed to a lance gear drive system 28 which includes a motor 30. The motor 30 is operatively connected to the lance tube 12 and is operable to rotate the lance tube 12 about the longitudinal axis 23. As a result, the lance tube 12 is configured to simultaneously rotate about the longitudinal axis 23 as the carriage assembly 14 advances the lance tube 12 into and out of the boiler. The motor 30 may induce rotation of the lance tube 12 using various known drive systems. As best shown in FIG. 2, for example, the motor 30 may be connected to the lance tube 12 via a lance chain drive 32. The lance chain drive 32 is operable to rotate a lance drive sprocket 34 mechanically linked to the lance tube 12. In this manner, the motor 30 drives the lance chain drive 32 to cause rotation of the lance drive sprocket 34, thereby causing the lance tube 12 to rotate therewith. It should be understood, however, that the lance tube 12 may also be configured to be advanced and retracted into and from the boiler without rotating about the longitudinal axis 23.

Figure 3:
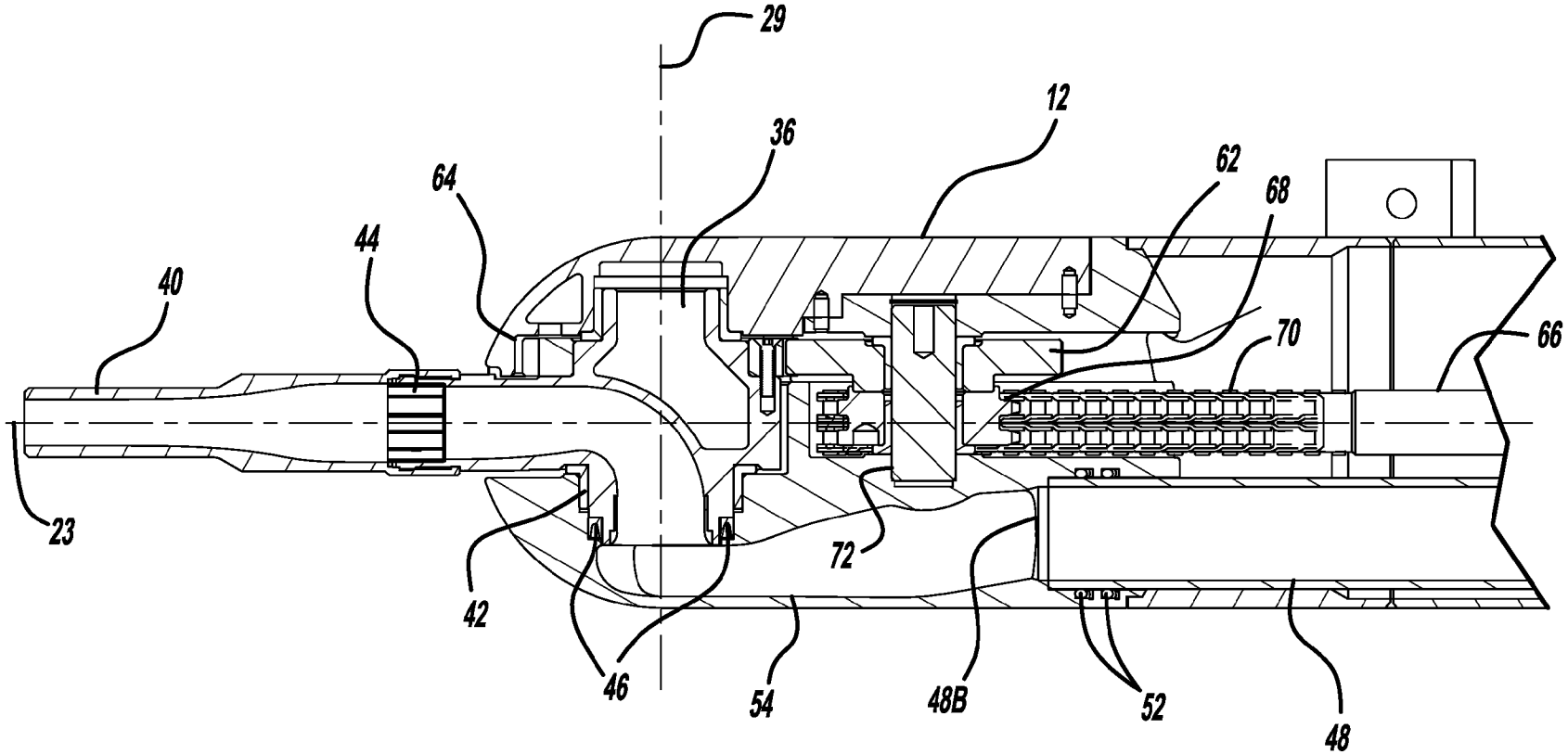
FIG. 3 is an enlarged cross-sectional side view of the sootblower taken along the lines 2-2 in FIG. 1.

Referring now to FIGS. 2 and 3, the lance tube 12 further includes an articulating wrist 36 rotatably mounted to the lance tube 12 at a distal end thereof and rotatable therewith. A wrist gear motor drive 38 comprising a motor 38A and gearbox 38B is affixed to the lance tube 12 at its proximal end, and is rotatable therewith. As will be explained in greater detail below, the wrist gear motor drive 38 is operatively connected to the articulating wrist 36 and is operable to rotate the articulating wrist 36 about a second axis 29 that is transverse to the longitudinal axis 23. Accordingly, the articulating wrist 36 is configured to simultaneously rotate about the second axis 29 as the articulating wrist 36 rotates about the longitudinal axis 23 in conjunction with the lance tube 12.

Figure 4:
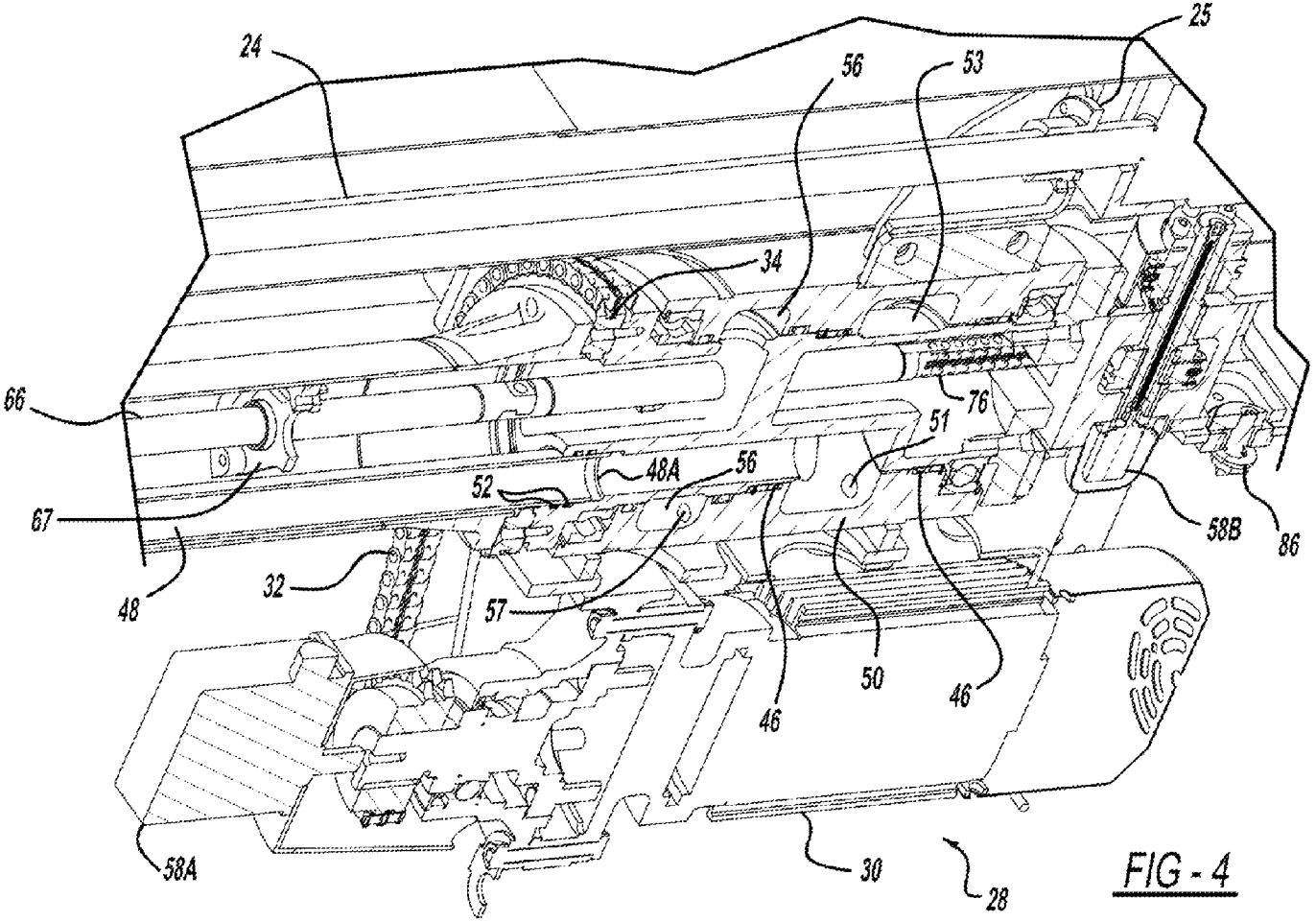
FIG. 4 is an enlarged cross-sectional view of FIG. 2 illustrating a lance gear motor drive.

A nozzle 40 adapted for conducting a cleaning medium such as, but not limited to, air, water, or steam, is coupled to the articulating wrist 36 and is rotatable therewith. One or more bushings 42 may be provided for supporting the nozzle 40 and/or articulating wrist 36. The nozzle 40 preferably includes a flow straightening vane 44 fixedly disposed therein and configured to aid the nozzle 40 in conducting a smooth flow of cleaning medium. The nozzle 40 is operatively connected to an external cleaning medium source (not shown) for supplying the nozzle 40 with the cleaning medium. Thus, the lance tube 12 includes a passageway for communicating the cleaning medium from the cleaning medium source to the nozzle 40. The passageway is defined by the interior surfaces of the lance tube 12, or the passageway may be defined by an elongated tube 48 disposed within the lance tube 12, as shown in FIGS. 3 and 4.

The elongated tube 48 comprises an inlet 48A fluidly connected to the cleaning medium source and an outlet 48B fluidly connected to the nozzle 40. The cleaning medium source may communicate cleaning medium to the inlet 48A by way of a flexible hose (not shown) connected to a cavity 51. As shown in FIG. 4, an annular chamber 53 surrounds the lance tube 12 for providing access to the cavity 51. Preferably, the flexible hose is connected to the cavity 51 through a rotary union 50 which does not rotate with the lance tube 12. It should be understood that the rotary union 50 and the carriage assembly 14 may be provided independently or jointly as a single unit. The rotary union 50 includes a packing gland having dynamic seals 46 for permitting relative rotary movement while preventing leakage of the cleaning medium. The rotary union 50 is operable to communicate cleaning medium to the cavity 51 independent of any rotation of the lance tube 12. Additionally, static seals 52 are provided near the inlet 48A and outlet 48B to prevent leakage from the elongated tube 48.

In a preferred embodiment, the elongated tube 48 supplies a cleaning medium to the nozzle 40 via a plenum or water flow chamber 54 interconnecting the outlet 48B and the nozzle 40. As best shown in FIG. 3, the water flow chamber 54 ends at a surface enabling it to communicate cleaning medium to the nozzle 40. Additionally, dynamic seals 46 disposed parallel to the longitudinal axis are provided to prevent cleaning medium from leaking from the nozzle 40. The water flow chamber 54 receives a supply of cleaning medium having a temperature less than the operating temperature of adjacent components (e.g., the nozzle 40, the articulating wrist 36, etc.). During operation of the sootblower 10, cleaning medium flowing through the water flow chamber 54 absorbs heat from the adjacent components and lowers their operating temperature, thereby protecting the adjacent components from the hot and corrosive environment experienced within the interior 19 of the boiler.

In one aspect of this embodiment, the cleaning medium source is a high pressure water source which feeds high pressurized water to a high pressure water chamber 53. The high pressure water chamber 53 is connected to the inlet 48A and is operable to supply high pressurized water to the nozzle 40 via the elongated tube 48. The supply of high pressurized water may be monitored by a flow control valve (not shown). In addition, the elongated tube 48 is preferably a high pressure water supply tube 48 configured to receive high pressurized water from the high pressure water chamber 53 via the inlet 48A, and supply the high pressurized water to the nozzle 40 via the outlet 48B.

The lance tube 12 may further include a plurality of air ports 57 connected to a compressed air supply (not shown) directing air to the air ports 57. As shown in FIG. 4, an annular chamber 56 surrounds the lance tube 12 for providing access to the air ports 57. The compressed air supply is connected to the air ports 57 through the rotary union 50, which allows air to be communicated to the sootblower independent of the rotation of the lance tube 12. The air ports 57 are operable to cool the internal components of the lance tube 12. Moreover, the air ports 57 are used to purge condensed cleaning medium from multiple air passageways within the lance tube 12 to prevent unwanted dripping of the condensate from the nozzle 40 when the sootblower 10 is not in use. For instance, upon completion of a cleaning cycle, a high pressure passage way, such as the high pressure water supply tube 48, may be purged to remove any remaining condensate therein. The air ports 57 can also be used to initially purge condensed cleaning medium from the lance tube 12 at a low pressure to prevent the condensate from being discharged against the boiler surfaces where the resulting thermal shock can cause structural damage to those surfaces. Furthermore, air ports 57 (not shown) near the distal end of the lance tube 12 may be used to continuously purge the interior of the lance tube 12 in order to help cool areas which are not in direct contact with the water flow chamber 54. Continuous purging of the lance tube 12 interior will also help reduce or eliminate slag or ash from building up on the gear assembly 60 and other components at the distal end of the lance tube 12.

A programmable controller (not shown), which may be a common microprocessor, is coupled to position sensors such as, but not limited to, a lance resolver 58A and a wrist resolver 58B (or position encoder), which provide information to the controller regarding the translational and rotational position of the lance tube 12 and the nozzle 40. Any now known or later developed techniques may be employed for outputting the translational and rotational position of the lance tube 12 and the nozzle 40 to the controller. Additionally, one or more limit switches (not shown) operatively connected to the controller may be provided for determining the longitudinal position of the carriage assembly 14. For instance, when the lance tube 12 is in a fully extended position, a limit switch may signal the controller to reverse the carriage assembly 14 upon completion of a cleaning cycle so as to retract the lance tube 12 back to its normal resting non-operation position.

The controller is programmed for the specific configuration of the boiler surfaces which are to be cleaned. The controller may be operable to control the rotational and translational speeds of the lance tube 12 as well as the supply and return flow of the cleaning medium. The controller thus regulates the amount or rate at which cleaning medium is discharged from the lance tube 12 into the boiler, the longitudinal position of the lance tube 12 as a function of time, and the length of time it takes for the sootblower 10 to complete an entire operating cycle.

Figure 5:
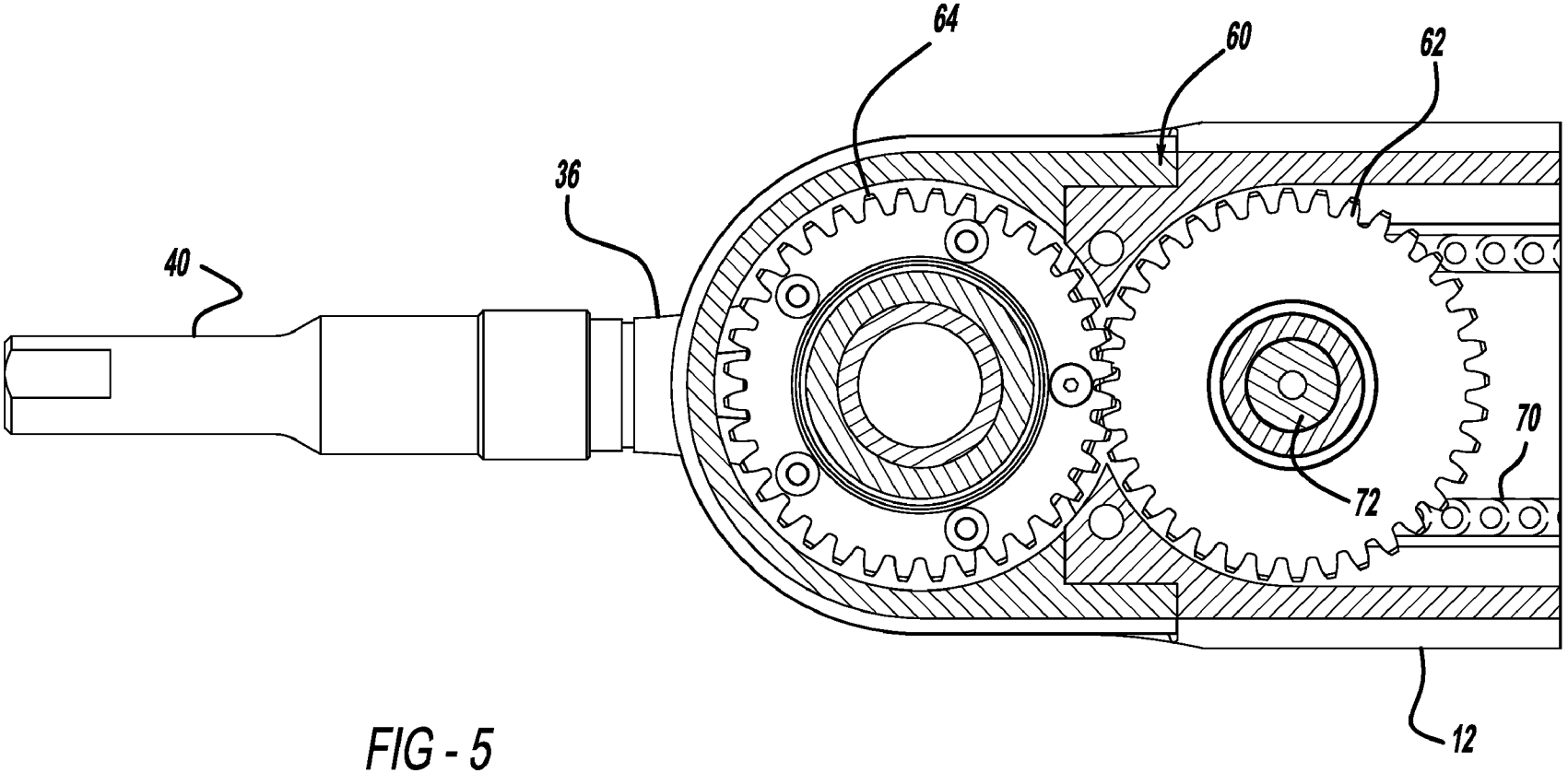
FIG. 5 shows a top view of FIG. 3.

As previously mentioned, the wrist gear motor drive 38 is operable to rotate the articulating wrist 36 about a second axis 29. In the preferred embodiment, the motor 38A induces rotation of the articulating wrist 36 via a gear assembly 60. As best shown in FIG. 5, the gear assembly 60 includes a drive gear 62 meshing with a driven gear 64, in which the driven gear 64 is rotatably coupled to the articulating wrist 36. The wrist gear motor drive 38 is operatively connected to the drive gear 62 and is operable to drive the drive gear 62. In response, the drive gear 62 drives the driven gear 64, which in turn, rotates the articulating wrist 36.

By implementing a gear assembly 60 to rotate the articulating wrist 36, stress and wear that would otherwise be transferred to the articulating wrist 36 and/or nozzle 40 is absorbed by the gear assembly 60. Moreover, the gear assembly 60, as well as components incorporated to actuate the gear assembly 60 (discussed below), are maintained at a distance from the "hot" distal end of the lance tube 12. As a result, the gear assembly 60 may negate or reduce the need for future maintenance and part replacement costs. In addition, use of a gear assembly 60 allows for a compact configuration which minimizes packaging space at the distal end of the lance tube 12 where the water flow chamber 54 is located.

According to another embodiment of the present invention, the wrist gear motor drive 38 is operable to rotate the articulating wrist 36 using one or more wrist actuation rods 66 operatively connected to the wrist gear motor drive 38. As illustrated in the figures, the lance tube 12 may include a pair of wrist actuation rods 66 longitudinally disposed therein. Additionally, one or more brackets or guides 67 may be provided to support the wrist actuations rods 66. The wrist actuation rods 66 are operatively connected to the gear assembly 60 and operable to drive the drive gear 62 using various techniques known to those of ordinary skill in the art.

Figure 6:
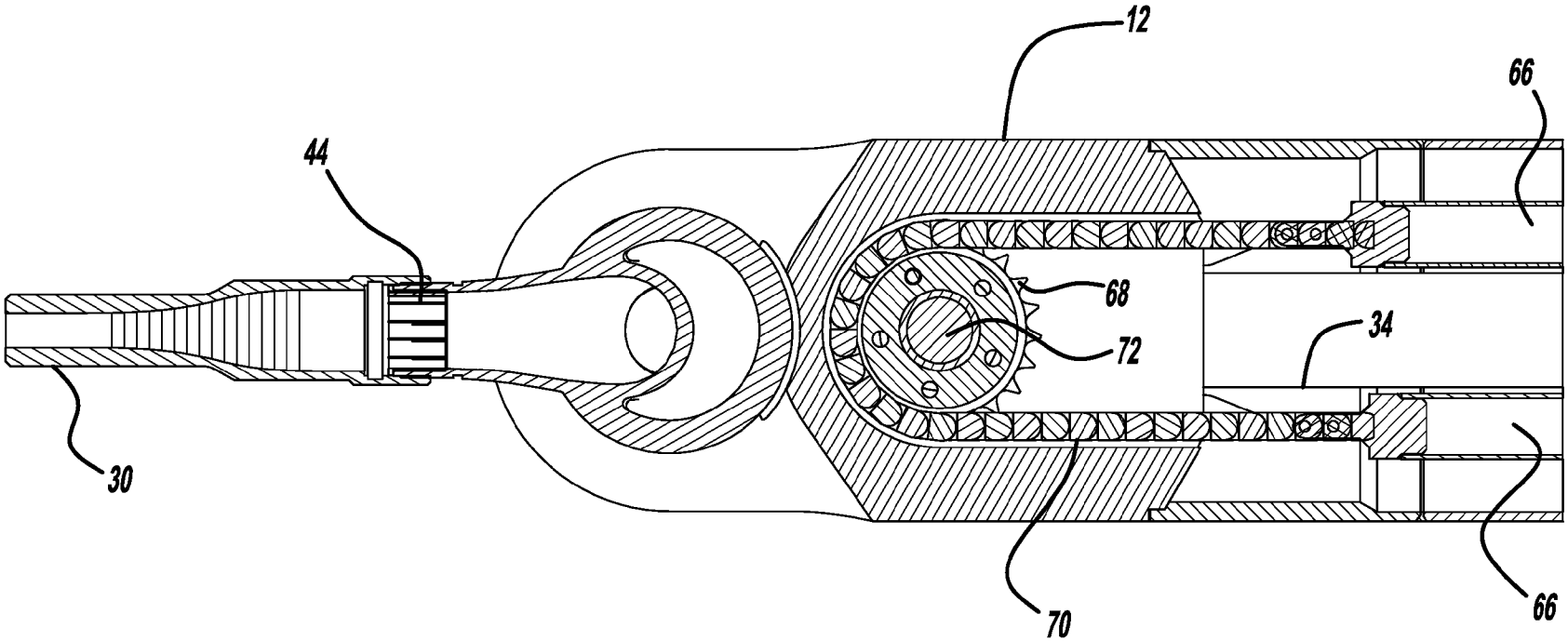
FIG. 6 is a cross-sectional side view of FIG. 3.

As best depicted in FIG. 6, for example, the wrist actuation rods 66 may be mechanically linked to a sprocket 68 via a drive chain 70 operable to rotate the sprocket 68. The sprocket 68 is linked to the drive gear 62 via a rotatable shaft 72 disposed within the lance tube 12. According to this arrangement, actuation of the actuation rods 66 induces rotation of the sprocket 68. Rotation of the sprocket 68 causes the shaft 72 to rotate, which in turn, drives the drive gear 62. As a result, rotation of the articulating wrist 36 may be accomplished according to the manner discussed above.

Figure 7:
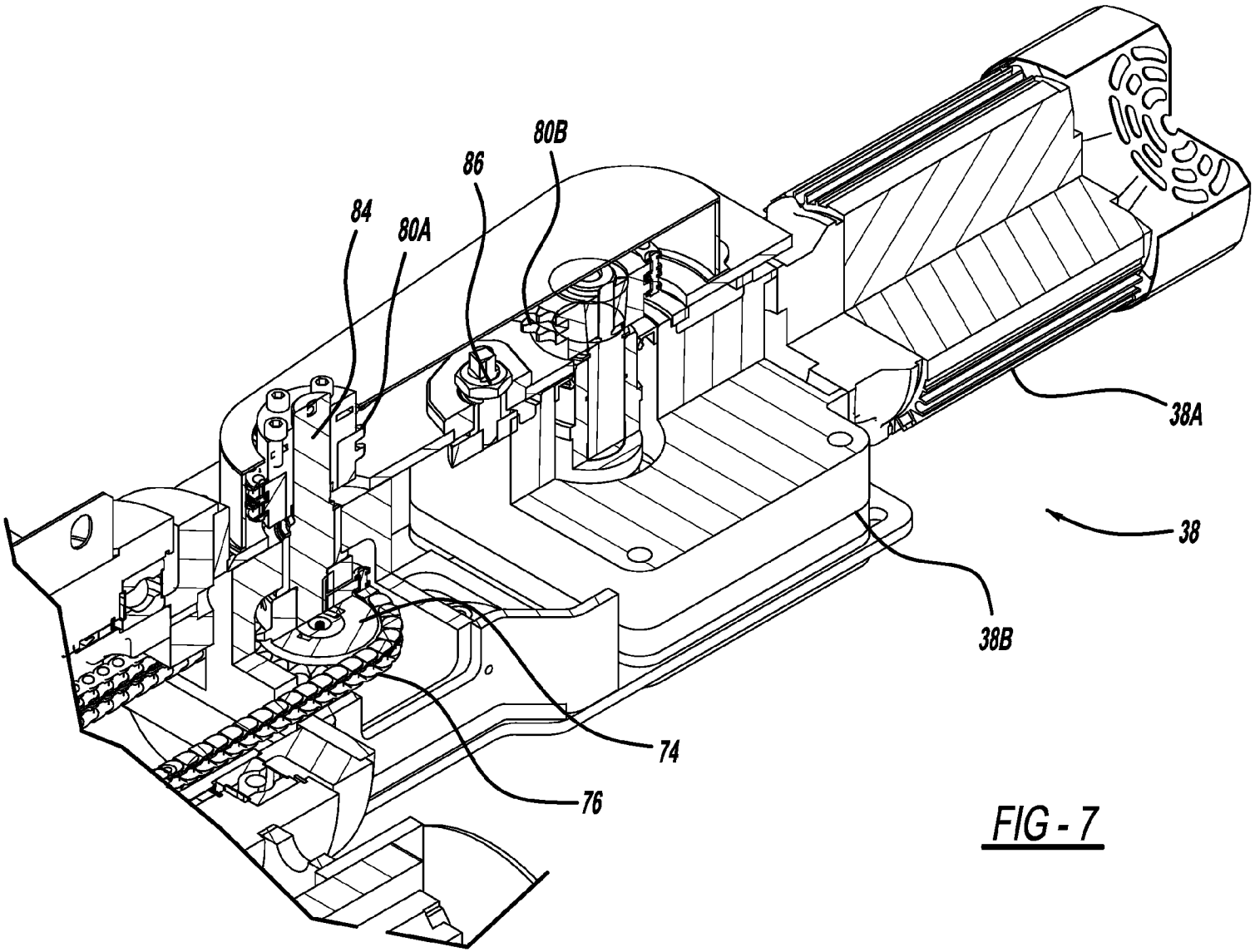
FIG. 7 is an enlarged cross-sectional view of FIG. 2 illustrating a wrist gear motor drive.

The wrist gear motor drive 38 may actuate the actuation rods 66 using various techniques known to those of ordinary skill in the art. As best shown in FIGS. 2, 4, and 7, for example, the wrist gear motor drive 38 includes a sprocket 74 mechanically linked to the wrist actuation rods 66 via a chain 76. The wrist gear motor drive 38 is operable to rotate the sprocket 74 by way of a chain drive system 78 coupled to the gearbox 38B. The chain drive system comprises a pair of sprockets 80A and 80B meshing with a drive chain 82. The chain drive system 78 may be mechanically connected to the sprocket 74 via a shaft 84 rotatable therewith. In operation, the motor 38A drives the chain drive system 78, thereby causing the shaft 84, and thus the sprocket 74, to rotate therewith. Rotation of the sprocket 74 drives the chain 76, which in turn, actuates the actuation rods 66.

While only one mechanism for rotating the articulating wrist 36 is shown in the figures, it should be well understood to those of skill in the art that the present invention is not so limited. For instance, the wrist actuation rods 66 may be configured to drive the drive gear 62 by way of a cable and pulley system (not shown). Thus, rather than using a sprocket 68 and drive chain 70, the wrist actuation rods 66 may be connected to a pulley via a cable. Additionally, it should also be understood that the gear assembly 60 may comprise a variety of gear arrangements known to those of ordinary skill in the art. For example, the gear assembly 60 may include any type of gears in meshing engagement, such as, but not limited to, spur gears, bevel gears, worm and worm gears, or any combination thereof.

Figure 8:
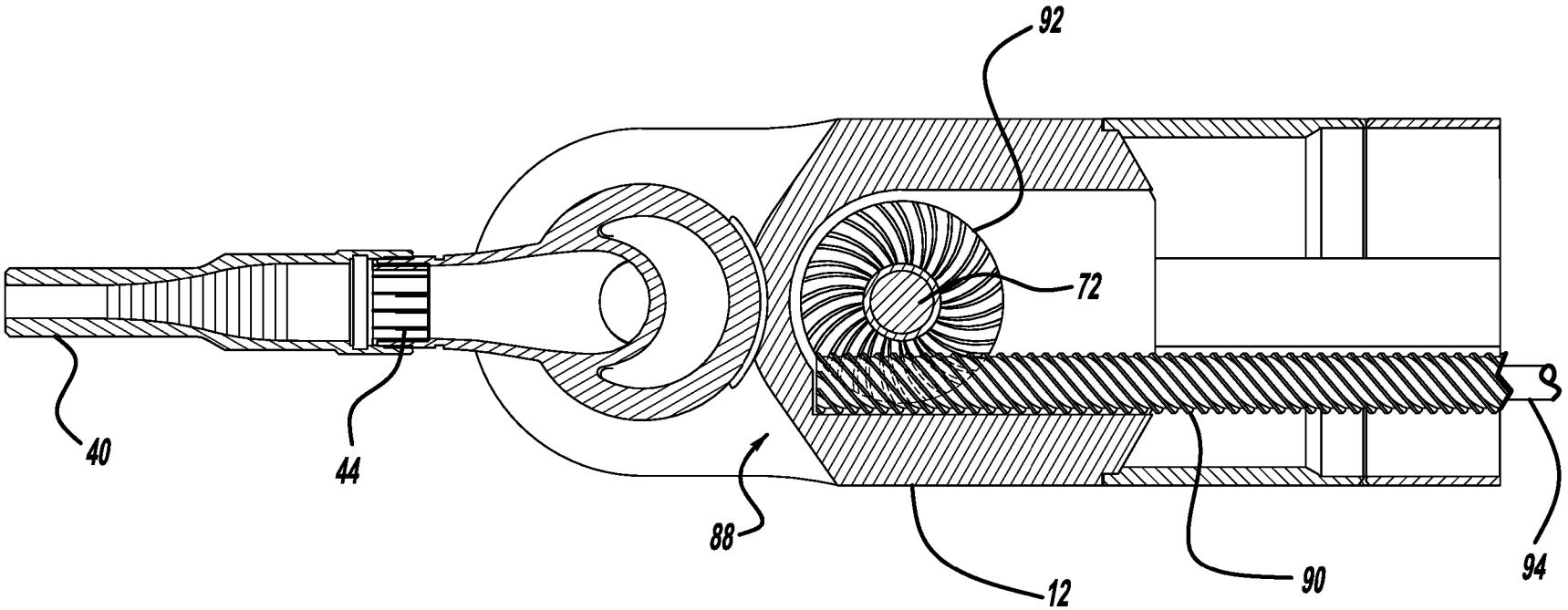
FIG. 8 is a cross-sectional side view of FIG. 3 according to a second embodiment of the present invention.

In an alternative embodiment, the wrist motor drive 38 is operable to rotate the articulating wrist 36 by way of a worm drive assembly 88 mechanically lined to the gear assembly 60. As shown in FIG. 8, for example, the worm drive assembly 88 comprises a rotatable worm 90 in meshing engagement with a worm wheel 92, wherein the worm wheel 92 is rotatably coupled to the drive gear 62 via the shaft 72. The wrist motor drive 38 is linked to the worm 90 by way of an elongated shaft 94 rotatable therewith. According to this arrangement, rotation of the articulating wrist 36 may be accomplished according to a manner similar to that described above with respect to the wrist actuation rods 50 and the drive chain 70. Specifically, the wrist motor drive 28 rotates the elongated shaft 94 to drive the worm drive assembly 88. Rotation of the worm 90 induces rotation of the worm wheel 92, which in turn, causes the shaft 72 to rotate therewith and drive the drive gear 62.

Furthermore, the wrist gear motor drive 38 may include rotary cams 86 for adjusting the tension of the drive chain 62. Alternatively, adjustable wedges or any other means known to those of ordinary skill in the art may be used for adjusting the tension of the drive chain 62. In addition, it should be understood that the wrist gear motor drive 38 may be enclosed by a shield or metallic frame designed to protect the sootblower 10.

Figure 9:
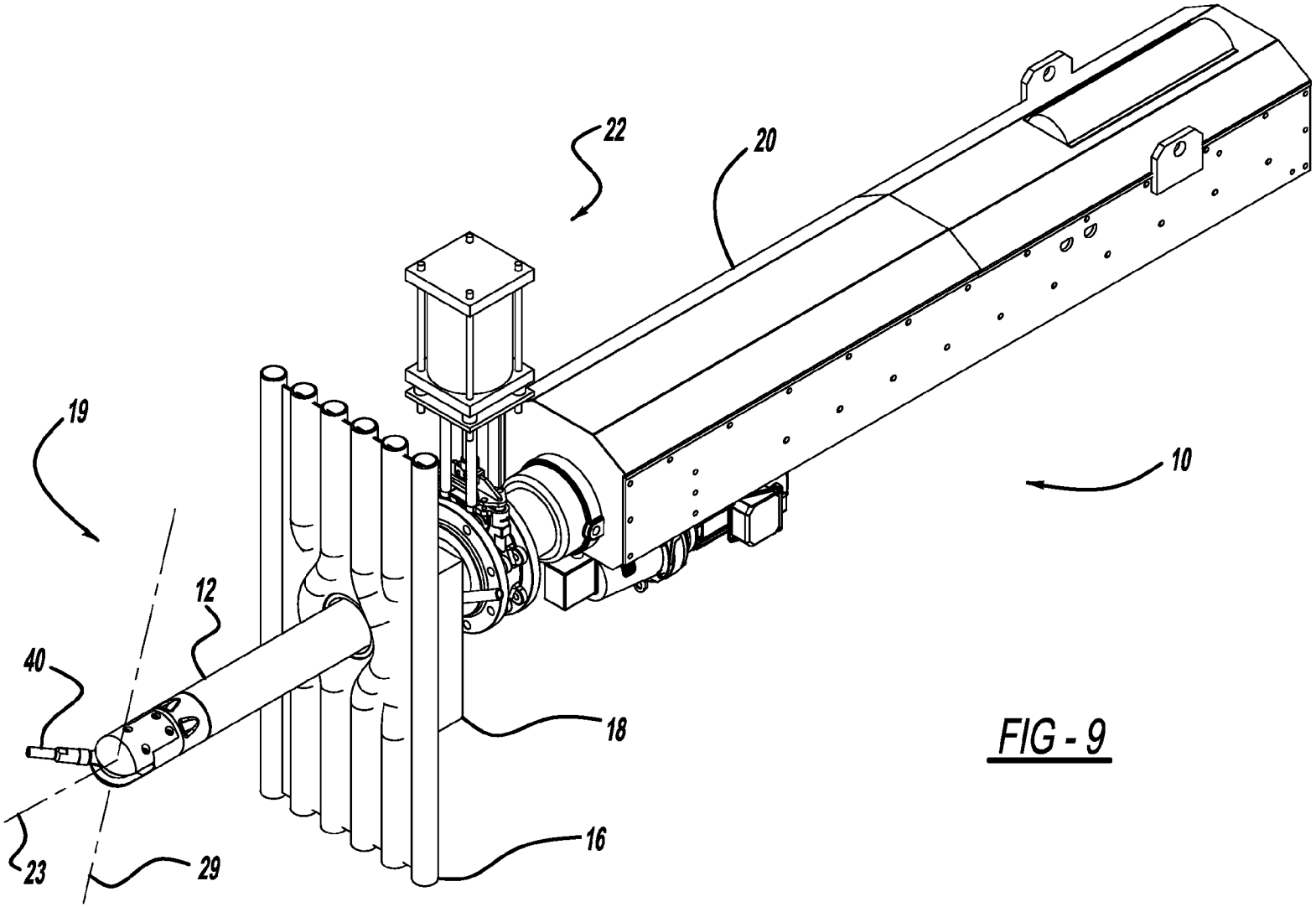
FIG. 9 is an isometric view of the sootblower in an operating position.

Operation of the sootblower 10 will now be explained with particular reference to FIG. 9. Upon actuation, the carriage assembly 14 advances the lance tube 12 along the longitudinal axis 23, such that the distal end of the lance tube 12 enters into the boiler through a wall 18 provided with a port 18A specifically designed to accept the lance tube 12. FIG. 9 illustrates the lance tube 12 extended into an interior volume 19 of the boiler to an operational position.

As the lance tube 12 is extended and retracted between resting and operating positions, the lance tube 12 may be rotated about the first axis 23 (i.e., its longitudinal axis 23). In addition, the articulating wrist 36 may be rotated about the second axis 29, either independently of or simultaneously with the rotation of the lance tube 12. Accordingly, rotation of the lance tube 12 and the articulating wrist 36 permit the nozzle 40 to pivot about the first and second axes 23 and 29 as the nozzle 40 discharges cleaning medium against heated surfaces of the boiler.

Furthermore, the lance tube 12 may be partially extended and/or retracted during the cleaning process in order to vary the cleaning range of the nozzle 40. For instance, the lance tube 12 may be partially extended in order to linearly advance the nozzle 40 along the first axis 23 and position it in closer proximity with an opposing wall. In sum, since the nozzle 40 is drivable along the first axis 23 and pivotable about the first and second axes 23 and 29, the nozzle 40 can be seen as having a multi-directional cleaning range capable of cleaning multiple surfaces of a boiler.

While the above description constitutes the preferred embodiment of the present invention, it will be appreciated that the invention is susceptible to modification, variation and change without departing from the proper scope and fair meaning of the accompanying claims. For instance, it is within the purview of this invention to employ a video imaging device mounted at the distal end of the lance tube 12, wherein the video imaging device could be implemented as a boiler inspection camera.

In addition, while only one nozzle has been shown in the figures and described hereinabove, it should be understood to those of ordinary skill in the art that the sootblower 10 may employ multiple nozzles operable to conduct one or more different cleaning fluids. By way of example, the sootblower 10 may employ two nozzles, wherein one nozzle is operatively connected to a first cleaning medium source and operable to project a first cleaning medium against heated surfaces of a boiler, and the second nozzle is operatively connected to a second cleaning medium source and operable to project a second cleaning medium against the heated surfaces of the boiler.

We claim:

1. A sootblower having a multidirectional cleaning range for directing a cleaning medium against heated surfaces in a heat exchanger, the sootblower comprising:

a lance tube for conducting the cleaning medium, the lance tube defining a first longitudinal axis and having a distal end and a proximal end;

a carriage assembly coupled to the lance tube to selectively advance and retract the lance tube into and out of the heat exchanger along the first longitudinal axis;

a first motor drive operatively connected to the carriage assembly and operable to translate the carriage assembly and the lance tube along the first longitudinal axis, the first motor drive enabling the carriage assembly to selectively advance and retract the lance tube distal end into and out of the heat exchanger;

a second motor drive operatively connected to the lance tube and operable to rotate the lance tube about the first longitudinal axis;

an articulating wrist rotatably coupled to the lance tube at the distal end thereof, the articulating wrist rotatable about a second axis that is transverse to the first longitudinal axis;

a third motor drive operatively connected to the articulating wrist and operable to rotate the articulating wrist about the second axis upon driving of the gear assembly, the gear assembly having a first gear meshing with a second gear, the first and second gears mounted for rotation and contained within the lance tube, the first gear being displaced from the lance tube distal end and being connected for driving by the third drive motor, the second gear being rotatably coupled to the articulating wrist and concentric with the second axis, the second gear being driven for rotation by the first gear;

a nozzle coupled to the articulating wrist and rotatable therewith, the nozzle being drivable along the first longitudinal axis and pivotable about the first longitudinal axis and the second axis, whereby the nozzle is operable to project the cleaning medium against the heated surfaces when the lance tube is advanced into the heat exchanger; and a cleaning medium source operatively connected to the nozzle and operable to supply the cleaning medium to the nozzle, the cleaning medium flowing along the length of the lance tube, through an internal passageway in the articulating wrist and into the nozzle.

2. The sootblower of claim 1, wherein the third motor drive is operatively connected to the gear assembly by way of at least one wrist actuation rod, the third motor drive being operable to actuate the at least one wrist actuation rod to drive the gear assembly.

3. The sootblower of claim 2, wherein the at least one wrist actuation rod is mechanically linked to a sprocket via a drive chain for rotating the sprocket, the sprocket being operatively connected to the gear assembly and operable to drive the gear assembly.

4. The sootblower of claim 3, wherein the sprocket is mechanically coupled to the first gear via a shaft, the shaft being rotatable with the sprocket and configured to drive the first gear; and wherein the at least one wrist actuation rod is operable to drive the drive chain to rotate the sprocket and the shaft.

5. The sootblower of claim 1, wherein the third motor drive is operatively connected to the gear assembly via a worm drive assembly, the third motor drive being operable to drive the worm drive assembly to drive the gear assembly.

6. The sootblower of claim 5, wherein the worm drive assembly comprises a worm in meshing engagement with a worm wheel, the worm wheel being rotatably coupled to the gear assembly via a shaft, the shaft being rotatable with the worm wheel and configured to drive the gear assembly.

7. The sootblower of claim 6, wherein the third motor drive is operatively connected to the worm by way of an elongated shaft rotatable therewith, the elongated shaft being operable to drive the worm to rotate the worm wheel and the shaft.

8. The sootblower of claim 1, wherein the cleaning medium source comprises a high pressure water chamber fluidly connected to the nozzle and operable to supply high pressurized water to the nozzle via a passageway defined by the lance tube.

9. The sootblower of claim 1, wherein the cleaning medium source comprises a high pressure water chamber fluidly connected to the nozzle via an elongated tube disposed within the lance tube, the elongated tube being configured to supply high pressurized water to the nozzle.

10. The sootblower of claim 1, wherein the cleaning medium source is coupled to the lance tube through a rotary union for permitting relative rotary movement of the lance tube while communicating cleaning medium thereto, the rotary union not being rotatable with the lance tube.

11. The sootblower of claim 1, wherein the nozzle includes a flow straightening vane fixedly disposed therein.

12. The sootblower of claim 1, wherein the third motor drive is affixed to the lance tube at the proximal end thereof and is rotatable therewith.

13. The sootblower of claim 1, further comprising a plurality of air ports operatively connected to a compressed air supply operable to communicate air to the air ports through a rotary union, the air ports being operable to purge condensed cleaning medium from multiple air passageways within the lance tube.

14. The sootblower of claim 13, wherein predefined areas within the lance tube are continuously purged to cool components not in direct contact with the cleaning medium.

15. A sootblower having a multidirectional cleaning range for directing a cleaning medium against heated surfaces in a heat exchanger, the sootblower comprising:

a lance tube for conducting the cleaning medium, the lance tube defining a first longitudinal axis and having a distal end and a proximal end;

a carriage assembly coupled to the lance tube to selectively advance and retract the lance tube into and out of the heat exchanger along the first longitudinal axis;

a first motor drive operatively connected to the carriage assembly and operable to translate the carriage assembly and the lance tube along the first longitudinal axis, the first motor drive enabling the carriage assembly to selectively advance and retract the lance tube distal end into and out of the heat exchanger;

a second motor drive operatively connected to the lance tube and operable to rotate the lance tube about the first longitudinal axis;

an articulating wrist rotatably coupled to the lance tube at the distal end thereof, the articulating wrist rotatable about a second axis that is transverse to the first longitudinal axis;

a third motor drive affixed to the lance tube and configured to rotate with the lance tube about the first longitudinal axis, the third motor being operatively connected to the articulating wrist and operable to rotate the articulating wrist about the second axis by way of a gear assembly including a first gear meshing with a second gear, wherein the first gear is displaced from the lance tube distal end and the second gear is rotatably coupled to the articulating wrist and concentric with the second axis;

a nozzle coupled to the articulating wrist and rotatable therewith, the nozzle being drivable along the first longitudinal axis and pivotable about the first longitudinal axis and the second axis, whereby the nozzle is operable to project the cleaning medium against the heated surfaces when the lance tube is advanced into the heat exchanger; and a cleaning medium source operatively connected to the nozzle and operable to supply the cleaning medium to the nozzle, the cleaning medium flowing along the length of the lance tube.

16. The sootblower of claim 15, wherein the third motor drive is operatively connected to the gear assembly by way of at least wrist one actuation rod mechanically linked to the first gear and operable to drive the first gear, the first gear being configured to responsively drive the second gear and thereby rotate the articulating wrist.

17. The sootblower of claim 15, wherein the third motor drive is operatively connected to the gear assembly by way of a worm drive assembly comprising a worm in meshing engagement with a worm wheel, the worm wheel being rotatably coupled to the first gear via a shaft rotatable therewith, the worm being operable to drive the worm wheel to rotate the shaft and the first gear, and wherein the first gear is configured to responsively drive the second gear and thereby rotate the articulating wrist.

18. The sootblower of claim 15, wherein the cleaning medium source is coupled to the lance tube through a rotary union for permitting relative rotary movement of the lance tube while communicating cleaning medium thereto, the rotary union not being rotatable with the lance tube.

* * * * *